United States Patent [19]

Quillévéré et al.

[11] 3,934,409

[45] Jan. 27, 1976

[54] GAS TURBINE COMBUSTION CHAMBERS

[75] Inventors: Hervé Alain Quillévéré, Issy-les Moulineaux; Jacques Emile Jules Caruel, Dammarie-les-Lys, both of France

[73] Assignee: Societe Nationale d'Etude et de Construction de Moteurs d'Aviation, Paris, France

[22] Filed: Mar. 12, 1974

[21] Appl. No.: 450,321

[30] Foreign Application Priority Data

Mar. 13, 1973 France ..... 73.08819

[52] U.S. Cl...... 60/39.65; 60/39.71; 60/39.72 R; 60/DIG. 11

[51] Int. Cl.[2]..... F02C 3/00; F02C 7/22

[58] Field of Search..... 60/39.65, 39.71, 39.72, 60/DIG. 11

[56] References Cited

UNITED STATES PATENTS

| | | | |
|---|---|---|---|
| 2,679,137 | 5/1954 | Probert | 60/39.65 |
| 3,034,297 | 5/1962 | Orchard et al. | 60/39.65 |
| 3,440,818 | 4/1969 | Quillevere et al. | 60/39.65 |
| 3,540,216 | 11/1970 | Quillevere et al. | 60/39.72 |
| 3,788,065 | 1/1974 | Markowski | 60/39.65 |
| 3,800,527 | 4/1974 | Marshall et al. | 60/39.72 |

*Primary Examiner*—C. J. Husar
*Assistant Examiner*—Robert E. Garrett
*Attorney, Agent, or Firm*—William J. Daniel

[57] ABSTRACT

A combustion chamber for a gas turbine engine, comprising an upstream portion divided longitudinally into a first chamber and a second chamber supplied with air in parallel, and a downstream portion in which the flows issuing from these two chambers mix, the first chamber comprising a primary combustion zone into which fuel is injected at an idling rating forming a substantially stoichiometric air - fuel mixture, and a secondary combustion zone supplied with secondary combustion air, and the second chamber, of the premixed burning type, being formed by a simple conduit upstream of which, for driving the gas turbine at the maximum rating, supplementary fuel is injected which burns on contact with a flame synchronizer.

9 Claims, 10 Drawing Figures

X
X'
ΦmA 42a
40a
40b
42b
40
18

40a'
42a'
40
18

40"
42"a
42"b
43
40"a
18

53b
39
53
11
53a
29
8

53b
11
53
53a 101
106
104
130
150
57
152
103
125
124
144
129
139
56
140
54
54a
54b
54'
54'a
54'b
55
55'
147
108
102
105

GAS TURBINE COMBUSTION CHAMBERS

BACKGROUND OF THE INVENTION

The present invention relates to the combustion chambers of gas turbine engines and especially aviation turbine jet engines, and more precisely concerns a non-polluting combustion chamber arrangement.

Efforts have been made hitherto to improve the operation of combustion chambers, their reliability, their weight and other similar characteristics, without taking very much account however of pollution, except as regards the emission of visible smoke. Thus one has arrived at the conventional concept consisting in injecting the fuel into a primary combustion zone followed by a secondary combustion or dilution zone, the primary zone being arranged so that the richness of the fuel-air mixture may be close to the stoichiometric richness for the conditions of maximum continuous rating, and that its volume should be at least equal to the value necessary to ensure re-ignition in flight at a specific altitude. This conventional concept, from the pollution viewpoint, presents the following drawbacks:

On idling while the aircraft is stationary or taxying, by reason of the low mean richness of the primary zone, the combustion efficiency is not very good and a large quantity of carbon monoxide and unburnt hydrocarbons is ejected in the vicinity of the ground;

At the maximum continuous rating and on take-off, the combustion efficiency is close to the optimum but the design of the chamber implies a long stay of the gases in the zones where the richness of the mixture is substantially stoichiometric and the temperature achieved very high, by reason of this richness and of the high values of the temperature and pressure at the entry to this chamber, this being favorable to the production of various nitrogen oxides.

SUMMARY OF THE INVENTION

According to the present invention these drawbacks are eliminated by dividing the upstream part of the combustion chamber into two distinct chambers which are supplied in parallel with combustion agent, namely a first chamber or idling chamber which may have the construction of a conventional combustion chamber and comprises means for injecting fuel, at a flow rate corresponding to the idling of the gas turbine, into a primary zone arranged so that the air-fuel mixture therein is substantially stoichiometric, followed by a secondary zone, and a second chamber ensuring the combustion of the fuel supplement corresponding to the running of the gas turbine at the maximum speed, this second chamber being of the premixed burning type, that is to say constituted by a conduit receiving a flow of combustion air at its upstream end into which the said fuel supplement can be injected and containing a flame stabilizer system, and by mixing the flows issuing from these two distinct chambers in the downstream part of the combustion chamber by means of a device acting by constriction of at least one of these flows.

The injection of fuel into the primary zone of the first chamber is utilized alone on idling. As the richness of the air-fuel mixture in the primary zone of the first chamber is substantially stoichiometric, the chemical combustion reactions develop under much more favorable conditions than in a conventional combustion chamber and consequently the emissions of carbon monoxide and unburnt hydrocarbons at the exhaust of the engine on idling are considerably reduced.

At the meximum rating, that is on take-off if the gas turbine is part of an aircraft gas turbine jet engine, fuel is further injected at a high supplementary flow rate and burnt in the second chamber, where the production of nitrogen oxides will be very low by reason of the high speed of flow of the gases. Moreover the gases issuing from the second chamber will be immediately placed, by the constriction device, in intimate contact with the cooler gases issuing from the first chamber and will therefore be subjected in the mixing chamber formed by the rear part of the combustion chamber to a phenomenon analogous to a "thermal quench" suddenly stopping the chemical reactions which generate nitrogen oxides. The production of these oxides will thus be very low in comparison with that of conventional combustion chambers.

At the maximum continuous speed of the gas turbine engine, that is in cruising flight if the turbine is part of an aircraft gas turbine jet engine, one continues to supply the injectors of the primary zone of the first chamber and one injects fuel at a complementary flow rate, which is obviously less than the supplementary flow rate corresponding to the maximum rating (at take-off), in a suitable region of the combustion chamber. In one embodiment this complementary fuel flow rate is injected into the secondary zone of the first chamber, advantageously by means of injectors which pass through air intake openings of this secondary zone. The mean richness of the air-fuel mixture in the whole of the first chamber will generally be a little greater than stoichiometric richness, so that the temperature there will be high and there will be a risk of producing a more abundant emission of nitrogen oxides than on idling and than at full speed (take-off).

It is however possible to obtain a maximum reduction of the emission of nitrogen oxides at the maximum continuous rating of the gas turbine (cruising) by adopting another embodiment in which the complementary flow rate of fuel is injected no longer into the secondary zone of the first chamber but into the second chamber. The mean richness in this second chamber will then be lower than at maximum rating and can even be less than the lean combustion limit; in this case it will be necessary to make use of an expedient to ensure combustion in this second chamber. One expedient consists, at the maximum continuous rating (cruising), in reducing the fuel flow rate supplying the idling injectors in order correspondingly to increase the fuel flow rate injected into the second chamber. Another expedient consists in locally enriching the air-fuel mixture in the second chamber by sharing the flow rate of fuel injected there at the complementary rate between the injection device normally provided for maximum rate and a further injection device.

It should be noted that the safe operation of the second chamber of the premixed burning type, that is of the type in which fuel is injected into an air flow at a distance upstream of a flame stabilizer system, is possible because the fuel is injected only at the maximum rating or at the maximum continuous rating, that is to say when the air flow passing through this second chamber is very rapid. The use of premixed burning, (injection of fuel upstream of the flame stabilization zone) in a conventional combustion chamber would be dangerous because during the starting up of the gas turbine there would be danger of producing a flame flashback which would damage the machine. Moreover it would generally be difficult in a combustion chamber of conventional construction to add fuel only to the air penetrating through the flame tube into the primary combustion zone without at the same time adding fuel to the secondary or dilution air and to the "film cooling" air. In aviation jet engines the use of pre-mixture is reserved for the after-burner.

The first and second chambers are advantageously supplied with air at different pressures, and preferably the first chamber at the higher pressure. The supplying of the first chamber at a higher pressure permits especially to increase the intensity of turbulence in this first chamber and consequently to further improve the efficiency of the combustion on idling. As the second chamber is at a lower pressure, this also permits to use the flames produced by the combustion of the idling fuel in the first chamber to ensure the ignition of the second chamber, by disposing an intercommunication conduit between these chambers which opens opposite to the flame stabilizer system.

BRIEF DESCRIPTION OF THE DRAWINGS

The invention will now be further described, by way of example, with reference to the accompanying drawings, in which.

DESCRIPTION OF PREFERRED EMBODIMENTS

Figure 1:
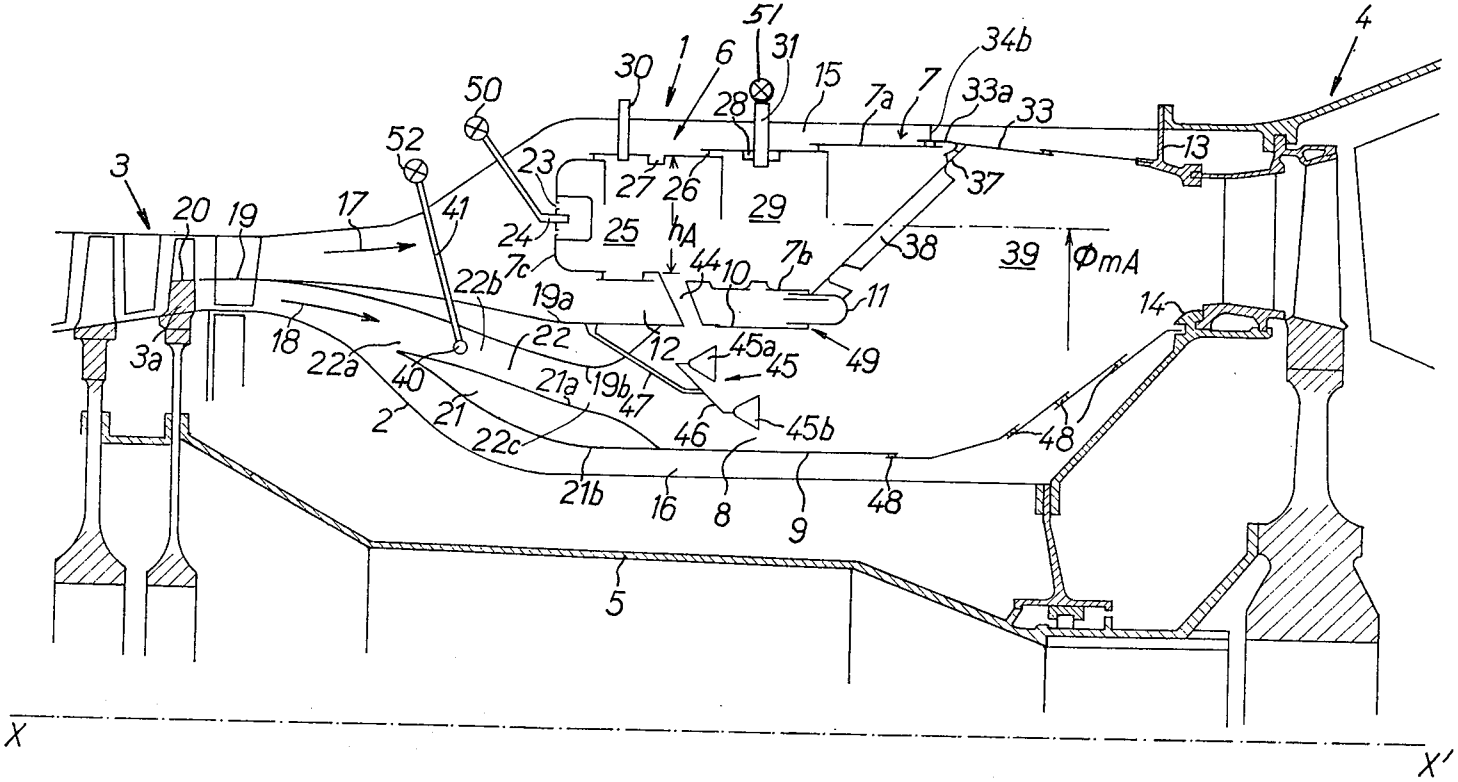
FIG. 1 is a diagrammatic axial half-sectional view of a combustion chamber according to the invention.

In FIG. 1 there is shown a combustion chamber 1 forming part of an aviation gas turbine jet engine which is not represented as a whole. The combustion chamber is contained in an annular casing 2, with axis X–X′, which is connected upstream to the output of a high pressure compressor 3 and downstream to a high pressure turbine 4 which drives the compressor 3 through a shaft 5. In well-known manner the air delivered by the compressor 3 into the combustion chamber 1 serves for the combustion therein of a fuel so as to produce hot gases which expand in the turbine 4, then in a low pressure turbine (not shown) and form behind it a jet which ensures the propulsion of the aircraft (not shown) upon which the gas turbine jet engine is mounted.

The upstream part of the annular space included within the casing 2 is divided into two distinct coaxial chambers supplied in parallel with air delivered by the compressor 3, namely an outer annular chamber 6 provided with a flame tube 7 and an inner annular chamber 8 provided with two coaxial tubular walls 9, 10, each of these two chambers occupying approximately half of the cross-section of the casing.

The flame tube 7 has the conventional form of an annular flame tube of a combustion chamber, comprising two coaxial tubular walls 7*a*, 7*b* connected upstream by an annular end piece 7*c*. The inner tubular wall 7*b* is connected downstream by a U-walled element 11 to the outer tubular wall 10 of the chamber 8, and the annular space 12 included between these two tubular walls 7*b*, 10 is freely open upstream towards the output of the compressor 3. The outer tubular wall 7*a* is prolonged, downstream of the flame tube 7, up to the vicinity of the downstream extremity of the casing 2, where it is connected to the latter by an annular piece 13. Likewise the inner tubular wall 9 of the chamber 8 is prolonged downstream up to the vicinity of the downstream extremity of the casing 2, where it is connected to the latter by a piece 14. The pieces 13 and 14 respectively close, downstream, two annular spaces 15 and 16 included respectively outside the wall 7*a* and inside the wall 9, which are freely open upstream towards the output of the compressor 3.

The flow of air delivered by the compressor 3 is divided into two coaxial annular flows 17, 18 by an annular separation 19 which is connected downstream to the tubular wall 10 and the upstream end of which, comprising a labyrinth seal, terminates opposite a partition 20 constituted by ribs called snubbers situated approximately at mid-height of the blades of the mobile blading 3*a* of the last stage of the compressor 3. The blades of the compressor are twisted in such manner that the external air flow 17 is at a pressure higher than that of the internal flow 18. The inner tubular wall 9 of the chamber 8 is connected upstream to a separation 21, and the separations 19 and 21, each having double walls 19*a*, 19*b* and 21*a*, 21*b* respectively, are streamlined in such manner that the annular air entry passage to the chamber 8 situated between the walls 19*b* and 21*a* has from upstream to downstream a convergent portion 22*a*, a portion 22*b* of uniform section and a divergent portion 22*c* forming a diffuser.

The end piece 7*c* of the flame tube 7 is pierced with a series of apertures 23 into each of which an injector 24 opens, the assembly of the injectors 24 being capable of atomizing into the primary combustion zone 25 the flow rate of fuel which ensures the idling of the gas turbine jet engine. These injectors 24 are of the prevaporization type as described especially in U.S. patent application Ser. No. 372,514 filed June 22, 1973 in other embodiments they could be replaced by prevaporization injectors of another type or by injectors of the pneumatic type, for example as described in U.S. patent application Ser. No. 414,945 filed Nov. 12, 1973.

Figure 2:
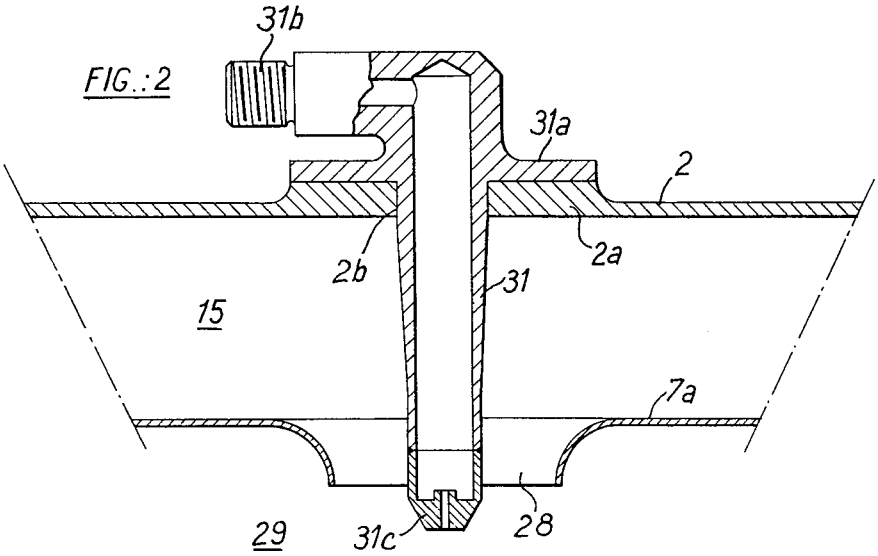
FIG. 2 is a view on a larger scale of a part of FIG. 1, showing a fuel injector passing through an air intake orifice of the secondary combustion zone.

The tubular walls 7*a* and 7*b* are each constituted, in conventional manner, by a plurality of sleeves assembled in such manner as to leave "film cooling" air inlet passages 26 between them, and are pierced by dilution air intake orifices 27 and 28 opening respectively into the primary zone 25 and the secondary combustion zone 29 of the chamber 6. The outer tubular wall 7*a* is further traversed by a certain number of spark plugs 30 penetrating into the primary zone 25 and by a certain number of injectors 31 penetrating into the secondary zone 29 through certain of the air intake orifices 28. FIG. 2 shows in detail the arrangement of one of these injectors 31, fixed at 31*a* by a screw (not shown) to a boss 2*a* of the casing 2 and passing through a bore 2*b* thereof to cross the annular space 15 in such manner that its injection head 31*c* is engaged coaxially in an air intake orifice 28. The injector 31 is provided with a connection 31*b* which permits the injector to be connected to a fuel inlet manifold (not shown) surrounding the casing 2.

Figure 3:
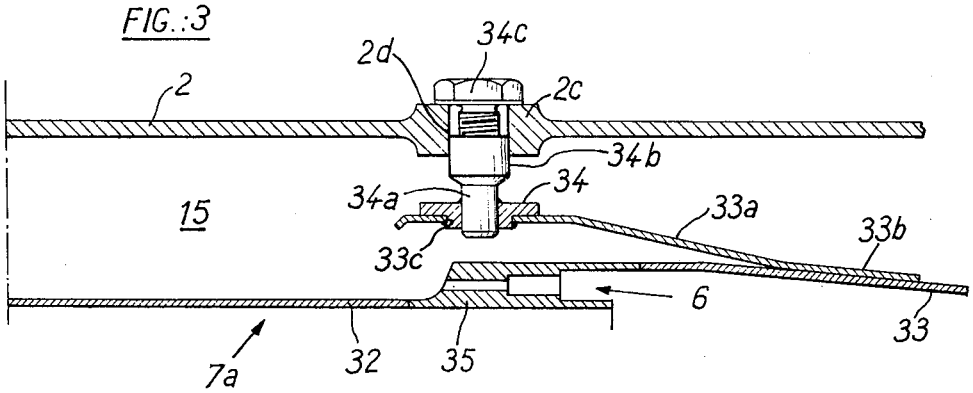
FIG. 3 is a detail view of another part of FIG. 1, illustrating the fixing of the flame tube of the first chamber to the casing of the combustion chamber.

The sleeve 33 situated at the downstream extremity of the secondary zone 29 is fixed to the casing 2 by means which are shown in detail in FIG. 3. To this sleeve 33 there is riveted at 33*b* an outer sleeve element 33*a* pierced in the vicinity of its upstream extremity with a plurality of bores 33*c* disposed in a ring, in each of which there is welded a washer 34 itself welded to a rod 34*a* fast with a nut 34*b* which is engaged in a slot 2*d* of a boss 2*c* of the casing 2 and held in this slot by a screw 34*c*. FIG. 3 also shows the connection of the sleeve 33 with the sleeve 32 situated immediately upstream, by means of a piece 35 similar to that described in U.S. patent application Ser. No. 295,585 of Oct. 6, 1972, this piece 35 reserving the cooling air inlet passage 26 between the two sleeves. On the inner face of the sleeve 33 (FIG. 1) there is welded the outer edge of an annular plate 37 the inner edge of which is welded to the sleeve forming the U-walled element 11. This plate 37 is pierced with orifices 38 which exert a constricting effect upon the flow of gases issuing from the secondary zone 29 of the first chamber or outer chamber 6, and dividing it in order to intermix it vigorously, in the rear part 39 of the combustion chamber 1 forming the mixture chamber, with the gas flow issuing from the second chamber or inner chamber 8.

Figures 4, 4A, 4B, 5, 5A:
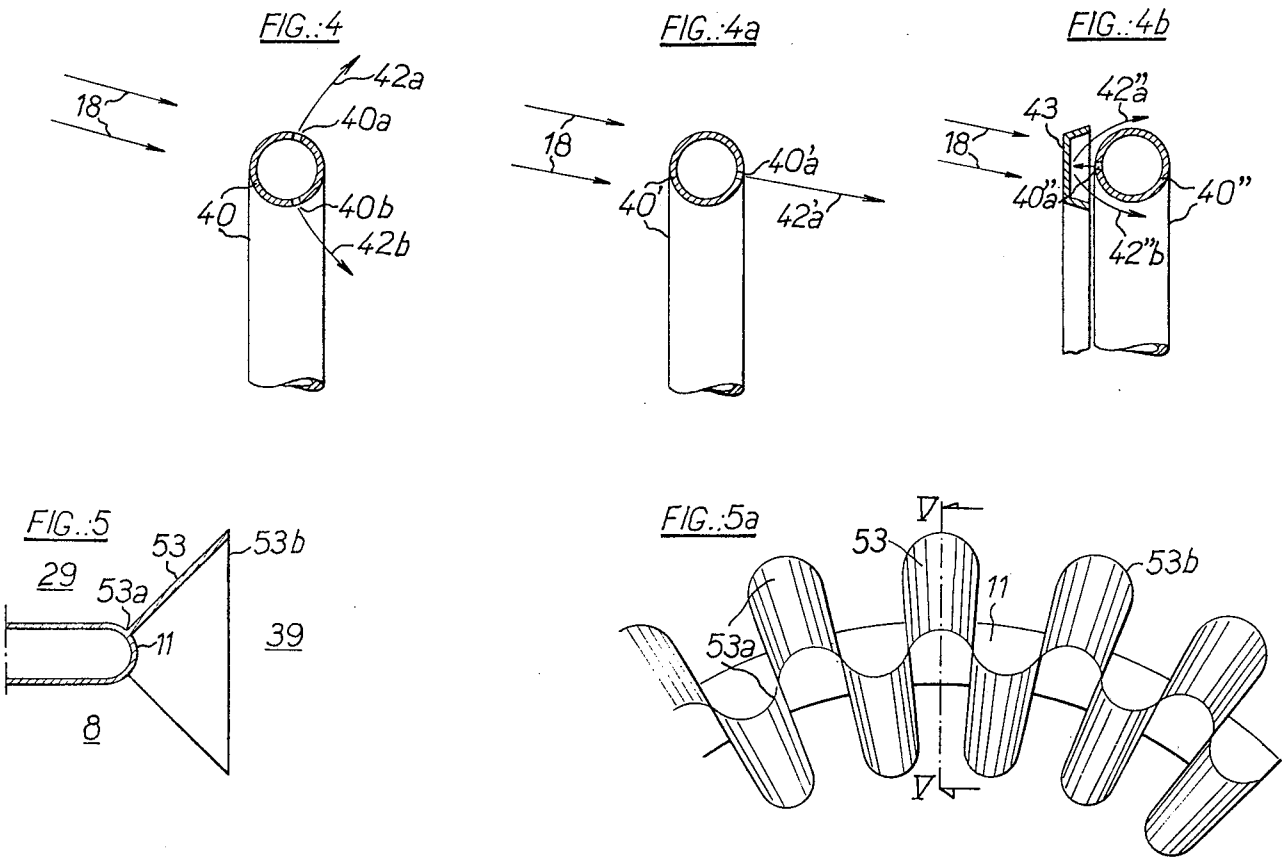
FIGS. 4, 4*a* and 4*b* are sectional views of three different types of injection assembly utilisable in the second chamber according to FIG. 1.
FIG. 5 is a view of another part of FIG. 1 showing in section along the line V—V in FIG. 5*a*, a variant of the mixture device acting by constriction.
FIG. 5*a* is a partial elevational view in the direction of the arrow F in FIG. 5.

In the portion 22*b* of uniform section of the annular air entry passage into the chamber 8 there is disposed a circular fuel injection manifold 40 supplied by a conduit 41 which passes through the separation 19 and the air flow 17 to be connected to a fuel supply collector (not shown). The injection manifold 40 is represented in greater detail in FIG. 4; it is pierced with injection orifices 40*a*, 40*b* serving for the emission transversely into the air flow 18 of fuel jets 42*a*, 42*b* which are deviated and atomized by this air flow and with it form an air-fuel mixture which flows downstream in the chamber 8. In a modification, the injection manifold 40 is replaced either by the manifold 40' according to FIG. 4*a*, pierced with orifices 40'*a* which emit fuel jets 42'*a* in the direction of the air flow 18, or by the manifold 40'' according to FIG. 4*b*, pierced with orifices 40''*a* emitting fuel jets counter-flow towards an annular anvil piece 43 which deviates them transversely at 42'' *a* and 42''*b*. In another modification (not shown) injection is effected by separate injectors.

Through the annular space 12 there passes a plurality of passages 44 disposed in a ring, leaving the primary zone 25 through the tubular wall 7*b* and opening through the tubular wall 10 into the chamber 8 opposite to a flame stabilizer system 45. These passages are disposed on a conventional floating tubular casing (not shown) permitting of absorbing the relative expansion movements of the two chambers. In the embodiment shown this flame stabilizer comprises two coaxial rings 45*a*, 45*b* of V-section supported by a structure 46 which is fixed to the partition 19 by a plurality of connecting rods 47 disposed in a ring. The tubular walls 9 and 10 are each provided downstream of the flame stabilizer 45 with "film cooling" air inlet passages 48 and 49 respectively.

Thus in FIG. 1 it is seen that the first or external chamber 6 has the conventional construction of a combustion chamber, with its flame tube 7 provided with apertures 23 and 27 which open into the primary combustion zone 25, secondary air intake orifices 28 which open into the secondary zone 29 and cooling air inlet passages 26. On the other hand the second or inner chamber 8 has the construction of a premixed burning chamber (analogous with a post-combustion chamber) freely open upstream to receive, through the annular passage 22, the air flow 18 with which the fuel injected by the assembly 44 forms a mixture which is ignited by incandescent gases coming from the primary zone 25 through the passages 44, the flames formed by the combustion being attached to the flame stabilizer 45. This premixed burning chamber 8 is included between the tubular walls 9 and 10, of which the part situated downstream of the flame stabilizer 45 forms a flame tube cooled by the air coming from the annular spaces 16 and 12 through the passages 48 and 49. The chamber 8 opens freely into the mixing chamber 39 situated in the downstream part of the combustion chamber 1 and included between the prolongations of the tubular walls 7*a* and 9, where the gas flow which has issued from this chamber 8 mixes, as has been seen, with that issuing from the chamber 6 through the orifices 38. At certain ratings, as will be seen hereinafter, the combustion is continued in the mixing chamber 39 and the mentioned prolongations of the tubular walls 7*a* and 9 form a flame tube which is cooled by "film cooling" by means of air films admitted from the spaces 15 and 16 through the passages 26 and 48.

The injection devices 24, 31 and 40 are supplied selectively with suitably regulated fuel by means which are shown diagrammatically in FIG. 1 in the form of metering valves 50, 51 and 52 respectively. On idling the injectors 24 alone are supplied and received a fuel flow rate $q_R$ which is capable of ensuring idling of the gas turbine jet engine. The orifices 23 and 27 are designed to permit penetration into the primary zone 25 of the proportion of the air delivered by the compressor 3 on idling which ensures in this zone 25 a substantially mean stoichiometric richness.

It will be explained hereinafter how this proportion of the air flow rate can be determined. The spark plugs 30 are supplied with electic current so that the substantially stiochiometric air-fuel mixture is ignited and burns with a very good combustion efficiency, the combustion initiated in the primary zone 25 being continued into the secondary zone 29 by virtue of the air supplement coming from the spaces 12 and 15 through the air intake orifices 28. The result is a very low emission of carbon monoxide and unburnt hydrocarbons. The hot gases formed by the combustion are discharged by the orifices 38 into the chamber 39 where they mix with the air flow entering at 18 into the second chamber 8 and issue directly therefrom into the mixture chamber 39.

At take-off, the injection assembly 40 of the second chamber is further supplied with a fuel flow rate $q'_o$ such that:

$$q'_o = q_o - q_R$$

$q_o$ being the fuel flow rate capable of ensuring the running of the gas turbine jet engine at take-off. As already explained, the air fuel mixture formed in the passage 22 by the atomisation of this fuel in the air flow 18 is ignited by the hot gases entering the chamber 8 through the passage 44 and burns downstream of the flame stabilizer system 45. The combustion brings the gases to a flame temperature sufficient to have suitable efficiency, but not too high. The combustion zone is crossed very rapidly by the gases by reason of the high speed of the air flow 18 entering freely into the chamber 8 through the convergent-divergent passage 22. Moreover the hot gases coming from this region mix intimately and very rapidly in the chamber 39 with the less hot gases issuing from the chamber 6 through the orifices 38. As explained in the introduction to the present description, the production of nitrogen oxides is greatly reduced.

The mixer device formed by the perforated partition 37 acts by constriction of the flow issuing from the first chamber 6, to divide it into a plurality of jets which penetrate deeply into the mass of hot gases issuing from the second chamber 8. In other embodiments the mixer device could act by constriction of the flow issuing from the chamber 8 or by constriction of the two flows. For example in the embodiments according to FIGS. 5 and 5*a*, the perforated partition 37 is replaced by a corrugated annular deflector 53 fixed to the rear of the U-walled element 11 which separates the chamber 8 from the secondary zone 29 of the chamber 6. The corrugations of this deflector 53 have an amplitude which increases from its leading edge 53*a*, which is welded to the wall element 11, to its free trailing edge 53*b*. Owing to this feature the two flows are divided into radial sections overlapped into one another, thus accelerating the homogenizing process.

In cruising, the injection manifold 40 is no longer supplied, but the injectors 24 are supplied still at the rate $q_R$ and the injectors 31 are supplied at a rate $q'_C$ such that:

$$q'_C = q_C - q_R,$$

$q_C$ being the fuel flow rate capable of ensuring the cruising rating of the gas turbine jet engine. The atomization of the fuel discharged by the injectors 31 is effected pneumatically by the speed of the secondary air jets entering through the orifices 28. The combustion instigated in the primary zone 25 is continued into the secondary zone 29, but as will be seen from the embodiment which will be described here in after, it is possible that the mean richness in the whole of the first chamber (primary zone 25 and secondary zone 29) may be greater than the stoichiometric richness. The combustion is then continued into the mixture chamber 39 on contact with the air which has passed through the second chamber 8.

The following example will show how the dimensional characteristics of the combustion chamber according to FIG. 1 can be determined in order to ensure that it will operate correctly in the manner as described. This example relates to a combustion chamber intended for a gas turbine jet engine of which the existing combustion chamber, of conventional type, occupies practically the whole internal volume of the casing 2 and operates with a mixture ratio (ratio of the fuel mass flow rate to the air mass flow rate) of which the values at the different running ratings are approximately the following:

| | | |
|---|---|---|
| idling | $\alpha$ R ~ | $6.10^{-3}$ |
| cruising | $\alpha$ c ~ | $16.10^{-3}$ |
| take-off | $\alpha$ D ~ | $22.10^{-3}$, |

the mean richness in the primary zone (quotient of the mixture ratio $\alpha$ in this zone by the stoichometric mixture ratio $\alpha_s$ equal to $68.10^{-3}$) having approximately the following values:

| | | |
|---|---|---|
| idling | $\psi$ R ~ | 0.38 |
| cruising | $\psi$ c ~ | 1 |
| take-off | $\psi$ D ~ | 1.37 . |

Since on idling the fuel flow rate $q_R$forms with the total air flow rate $\Sigma\ Q_R$ supplying the existing fuel chamber a mixture in the ratio $\alpha_R$, the air flow rate forming a stoichiometric mixture (mixture ration $\alpha_s$) with this fuel flow rate $q_R$ will obviously be the product of this total air flow rate $\Sigma Q_R$ by the quotient $\alpha_R/\alpha_s$, that is to say approximately by 8 to 9%.

The primary air intake orifices 23 and 27 into the primary zone 25 (FIG. 1) will thus be calculated to permit penetration of about 8.5% of the total air flow delivered by the compressor 3 into this zone 25; thus it will be ensured that the mixture will be substantially stoichiometric on idling in the primary zone 25. The secondary air intake orifices 28 will be calculated to permit penetration into the secondary zone 29 of about 10% of this total air flow rate, which will ensure for idling combustion a progressivity favorable to the completion of the reactions. As regards the cooling air inlet passages 26, 48 and 49, these will be calculated to permit passage into the three chambers 6, 8 and 39 of approximately 45% of the total air flow rate. The air flow rate 18 passing through the second chamber 8 will thus be the complement, that is approximately 36.5%, of the total air flow rate.

The volume $V_{PA}$ of the primary zone 25 is to be calculated to ensure at least the same re-ignition ceiling as the existing chamber, the primary zone of which has a known volume $V_P$. For this it is sufficient that the volumes should be proportional to the air flow rates, or in other words that the ratio $V_{PA}/V_P$ should be equal to the ratio between the idling richness $\alpha_R$ in the primary zone of the existing combustion chamber and the richness in the primary zone 25 (which is close to unity. Thus one may assume:

$$V_{PA} = 0.38\ V_P,$$

if one calls $\phi_{mA}$ and $h_A$ ( see FIG. 1) the mean diameter and the height of the primary zone of the chamber 6, $\phi_m$ and $h$ the mean diameter and the height of the primary zone of the existing combustion chamber (not shown), one has substantially:

$$\frac{V_{PA}}{V_P} = \frac{\phi_{mA} = h_A^2}{\phi_m = h^2}$$

since in the conventional art of combustion chambers, the length of the primary zone is proportional to its height, wherefore:

$$h_A/h = \sqrt{0.38\ \phi_m/\phi_{mA}}$$
$$= 0.61\ \sqrt{\phi_m/\phi_{mA}}$$

The ratio $\phi_m\ /\ \phi_{mA}$ is less than 1, and for a specific volume $V_{PA}$ one can reduce the height $h_A$ by increasing slightly the length of the primary zone 25, which a priori is not troublesome. Consequently the height $h_A$ can be close to $h/2$. It further results from the proportionality between the volumes and the air flow rates (which was adopted at the beginning for the calculation of $V_{PA}$)that the speeds of air flow in the primary zone 25 are the same as in the primary zone of the existing combustion chamber. Thus it is seen that the division of the cross-section of the casing into two equal parts to form the two chambers 6 and 8 is compatible with re-ignition at altitude, which is an imperative condition.

It is known that for similar aerodynamic and geometric constructions, which is the case with the two primary zones of volume $V_{PA}$ and $V_P$, the combustion efficiency is only a function of the "aerodynamic pressure load head" and of the richness. At given inlet pressure and temperature, the "aerodynamic pressure load" is proportional to the quotient of the air flow rate by the volume; thus it has the same value in the primary zone 25 as in the primary zone of the existing combustion chamber, which guarantees a clearly superior idling combustion efficiency for the combustion chamber according to the invention, better adapted in richness.

At take-off, the injectors 24 and 40 being supplied respectively with fuel at the rates $q_R$ and $q'_O$, as explained, the primary zone 25 of the chamber 6 will operate at slightly reduced richness, for example $\psi = 0.7$, because the air flow rate of the first chamber will be greater than on idling. A simple calculation, which the person acquainted with the art can carry out easily, shows that the richness of the air-fuel mixture in the chamber 8 will then be of the order of 0.75. It is of course possible to seek an optimization of the operation of the chamber 8 in order to minimize the production of nitrogen oxides, for example to reduce the richness therein by slightly reducing the air flow rate in the primary zone 25 (which slightly increases the richness in this zone) and by reducing the cooling air flow rate, or on the contrary to increase the richness in the chamber 8 beyond stoichiometric richness (but not too much however, in order to avoid smoke) by reducing the air flow rate 18, which permits of increasing the dilution air flow rate and the cooling air flow rate.

In cruising, as the injection manifold 40 is no longer supplied and as the injectors 24 and 31 are supplied respectively at the rates $q_R$ and $q'_C$, calculation shows that the mean richness of the air-fuel mixture in the whole of the chamber 6 (zones 25 and 29), is approximately 1.27.

As was also indicated in the introduction to the present description, if in cruising the fuel flow rate $q'_C$ were no longer injected into the zone 29 but through the injection manifold 40 into the chamber 8, there would be risk of richness in this latter chamber being at the limit of lean combustion. A calculation which can be carried out easily by the person acquainted with the art shows in fact that this richness would be of the order of 0.39.

Figure 6:
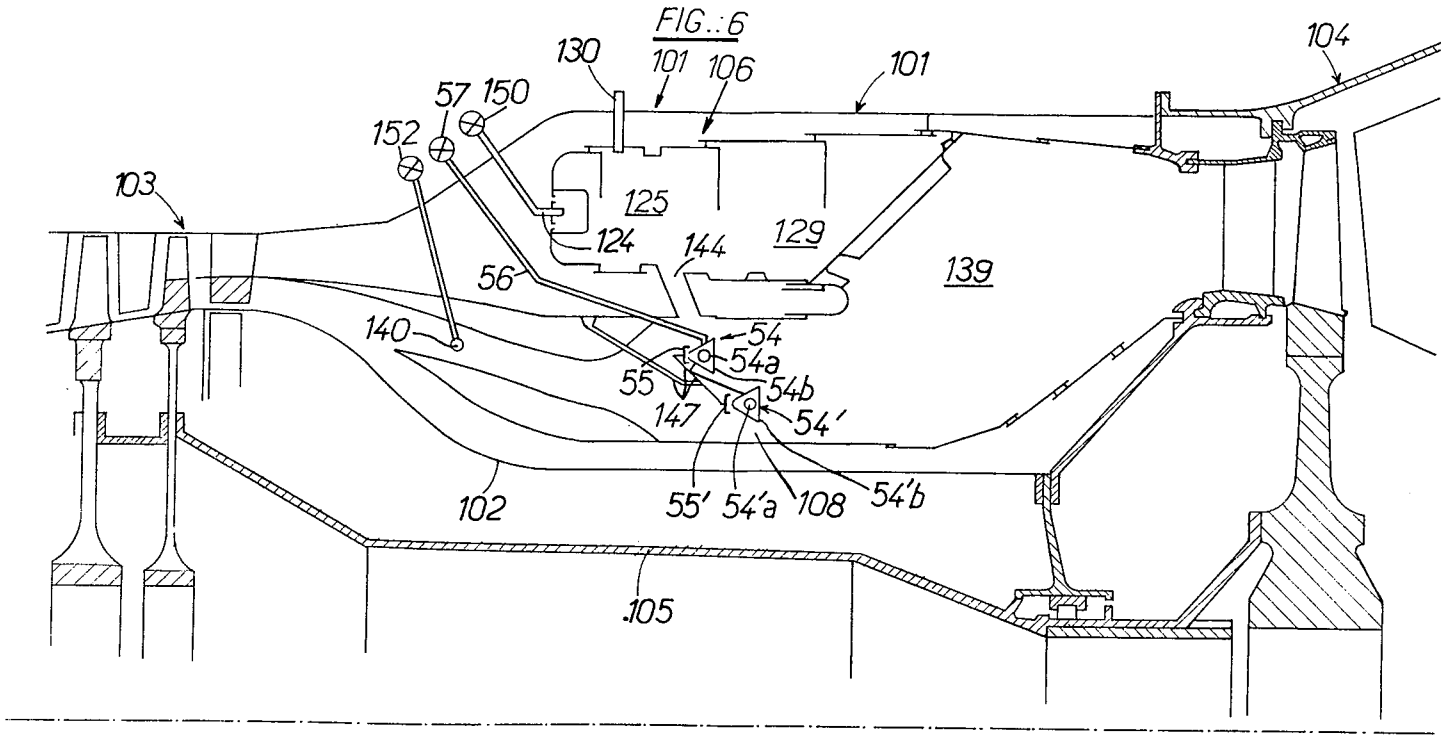
FIG. 6 is a view similar to FIG. 1 showing a modification.

If one makes use of expedient consisting in reducing to a value $q'_R$, in cruising, the fuel flow rate supplying the injectors 24 so that the richness in the zone 25 is of the order of 0.5, and in injecting the complementary rate $q_C - q'_R$ through the injection manifold 40, calculation shows that the richness in the chamber 8 will be of the order 0.5 likewise. FIG. 6 shows an embodiment comprising the use of the other mentioned expedient, which consists in the provision in the second chamber of a special injection device for cruising. In this FIG. 6 the elements acting the same part as in FIG. 1 are designated by the same reference numerals increased by 100 units. The injections 31 according to FIG. 1 are omitted and the rings 45*a* and 45*b* of the flame stabilizer system are each replaced by a burner ring 54 and 54' of known type, comprising a circular injection manifold 54*a* and 54'*a* contained in a flame holder ring 54*b*, *54'b* of V-section. The injection assemblies are supplied with fuel through a pipe 56 equipped with a cock 57, and when the latter is open each of them delivers counter flow, through the ports of the ring 54*b*, *54'b*, fuel jets against an annular anvil piece 55, 55'. This device, the operation of which was described in French patent application No. 7213396 of Apr. 17, 1972 ensures the atomization of the fuel in the region of the chamber 108 close to the burner rings 54 and 54'. The richness of the air-fuel mixture in this region, when in cruising the cock 52 is partially closed and the manifolds 54*a* and 54'*a* are supplied with fuel at a suitable rate, is sufficient to ensure combustion. At take-off the cock 57 is closed and the injection manifold 140 is supplied with fuel at the rate $q_o - q_R$.

Of course the forms of embodiment as described are only examples and they could be modified, especially by substitution of equivalent technical means, without thereby departing from the scope of the invention as defined in the appended claims. In particular the second chamber could be supplied with air at a higher pressure level than the first chamber, or the two chambers could be supplied at the same pressure. One could provide an ignition device in the second chamber and eliminate the intercommunication passages 44 or 144. Obviously one would not depart either from the scope of the invention by reversing the positions of the two chambers, that is to say by placing the first chamber within the second chamber located externally thereof.

What is claimed is:

1. A combustion chamber arrangement for a gas turbine engine having air commpressor means, (a) an upstream portion; (b) partitioning means extending longitudinally of the upstream portion and defining therein a first chamber and a second chamber, the first chamber forming a combustion chamber comprising (1) a primary combustion zone having primary air intake means, idling fuel injection means and ignition means, and (2) a secondary combustion zone having secondary air intake means, and the second chamber forming a combustion chamber of the premixed burning type comprising a conduit having supplementary fuel injection means in an inlet region thereof, and a flame stabilizer system in a region intermediate said inlet region and an outlet of the conduit; (c) means in the air compressor means for supplying a first flow of air to the first chamber to feed (1) the primary combustion zone with primary combustion air through the primary intake means and (2) the secondary combustion zone with secondary combustion air through the secondary air intake means, and for supplying a second flow of air to the inlet region of the conduit; (d) means for running the gas turbine engine at idling speed comprising means for supplying fuel to said idling fuel injection means for said primary combustion zone at an idling flow rate to form a substantially stoichiometric air and fuel mixture with the primary combustion air in the primary zone at said idling speed of the gas turbine engine; (e) supplementary means for running the gas turbine engine at maximum speed comprising mean for supplying fuel to said supplementary fuel injection means at a supplementary flow rate to form a premixed air and fuel mixture with the second flow of air in said intermediate region of said conduit, and means for igniting said premixed air and fuel mixture in said intermediate region; (f) a downstream portion forming a mixture chamber to receive first and second gas flows issuing from the first and second chambers, respectively; and (g) means for producing at least one constriction of at least one of said gas flows at its entry into the downstream portion in order to produce intermixing of the two gas flows in the mixture chamber.

2. A combustion chamber arrangement as claimed in claim 1, wherein said air supply means (c) comprise means for supplying the first flow of air at a first pressure and for supplying the second flow of air at a second and different pressure.

3. A combustion chamber arrangement as claimed in claim 2, wherein the first pressure is higher than the second pressure, and said means for igniting said premixed air and fuel mixture comprise at least one passage leading from said primary combustion zone of the first chamber to said intermediate region of said conduit.

4. A combustion chamber arrangement as claimed in claim 1, further comprising means for running the gas turbine engine at maximum continuous speed including complementary fuel injection means for injecting fuel directly into said secondary combustion zone, means for shutting off said supplementary fuel injection means, and means for supplying fuel to the complementary fuel injection means at a flow rate complementary to said idling flow rate.

5. A combustion chamber arrangement as claimed in claim 1, wherein the partitioning means further define a spacing around the first combustion chamber in said upstream portion, said secondary air intake means comprise a plurality of orifices leading from said spacing to said secondary combustion zone, and said air supply means comprise means for feeding said spacing with air from said first flow of air.

6. A combustion chamber arrangement as claimed in claim 5, further comprising means for running the gas turbine engine at maximum continuous speed including complementary fuel injection means for injecting fuel directly into said secondary combustion zone extend through at least part of said secondary air intake orifices means for shutting off said supplementary fuel injection means, and means for supplying fuel to the complementary fuel injection means at a flow rate complementary to said idling flow rate.

7. A combustion chamber arrangement as claimed in claim 1, further comprising means for running the gas turbine engine at maximum continuous speed including means for supplying fuel to said idling fuel injection, means at a reduced idling flow rate lower than said idling flow rate, and means for supplying fuel to said supplementary fuel injection means at a flow rate complementary to said reduced idling flow rate.

8. A combustion chamber arrangement as claimed in claim 1, further comprising means for running the gas turbine engine at maximum continuous speed, including means for supplying fuel to said supplementary fuel injection means at a reduced flow rate lower than said supplementary flow rate, and complementary fuel injection means for injecting fuel into said intermediate region of said conduit, at a flow rate complementary to said idling and reduced flow rates.

9. A combustion chamber arrangement as claimed in claim 8, wherein said complementary fuel injection means comprise injection manifold means for injecting fuel adjacent said flame stabilizer system.

* * * * *

UNITED STATES PATENT AND TRADEMARK OFFICE

CERTIFICATE OF CORRECTION

PATENT NO. : 3,934,409

DATED : January 27, 1976

INVENTOR(S) : Herve Alain Quillevere et al

It is certified that error appears in the above-identified patent and that said Letters Patent are hereby corrected as shown below:

In the Claims:

Column 10 (Claim 1), line 31, after "means," insert -- comprising --; line 57, after "primary" insert -- combustion --.

Column 12 (Claim 6), line 5, change "extend" to -- extending --; line 7, insert a comma after "fices".

Column 12 (Claim 7), line 14, cancel the comma after "injection" at the end of the line.

Signed and Sealed this

*thirteenth* Day of *April 1976*

[SEAL]

*Attest:*

RUTH C. MASON
*Attesting Officer*

C. MARSHALL DANN
*Commissioner of Patents and Trademarks*